US008302530B2

(12) United States Patent
Zindl et al.

(10) Patent No.: US 8,302,530 B2
(45) Date of Patent: Nov. 6, 2012

(54) STAMP

(75) Inventors: Peter Zindl, Obertraun (AT); Ronald Kreilhuber, Weisskirchen (AT); Johann Wilflingseder, Dorf an der Pram (AT)

(73) Assignee: Trodat GmbH (AT)

( * ) Notice: Subject to any disclaimer, the term of this patent is extended or adjusted under 35 U.S.C. 154(b) by 714 days.

(21) Appl. No.: 12/308,930

(22) PCT Filed: Jun. 21, 2007

(86) PCT No.: PCT/AT2007/000304

§ 371 (c)(1),
(2), (4) Date: Sep. 23, 2009

(87) PCT Pub. No.: WO2008/000005

PCT Pub. Date: Jan. 3, 2008

(65) Prior Publication Data

US 2010/0050891 A1 Mar. 4, 2010

(30) Foreign Application Priority Data

Jun. 26, 2006 (AT) ..... A 1071/2006

(51) Int. Cl.
*B41K 1/02* (2006.01)
*B41K 1/42* (2006.01)

(52) U.S. Cl. ..... 101/333; 101/327; 101/405

(58) Field of Classification Search ..... 101/103, 101/109, 327, 333, 405, 406; *B41K 1/00, B41K 1/02, 1/42*

See application file for complete search history.

(56) References Cited

U.S. PATENT DOCUMENTS

| | | | | |
|---|---|---|---|---|
| 317,853 | A * | 5/1885 | Richford | 101/333 |
| 5,105,738 | A | 4/1992 | Mehaffey | |
| 6,098,541 | A | 8/2000 | Miyata | |
| 6,679,168 | B1 | 1/2004 | Shih | |
| 6,925,933 | B1 | 8/2005 | Shih | |
| 7,216,586 | B1 * | 5/2007 | Yu | 101/333 |

FOREIGN PATENT DOCUMENTS

| | | | |
|---|---|---|---|
| DE | 29527 | C | 4/1884 |
| EP | 0 065 919 | A1 | 12/1983 |
| EP | 1 250 234 | B1 | 7/2003 |
| FR | 1.252.120 | A | 1/1961 |
| WO | WO-01/49511 | A1 | 7/2001 |

* cited by examiner

*Primary Examiner* — Leslie J Evanisko
(74) *Attorney, Agent, or Firm* — Lerner, David, Littenberg, Krumholz & Mentlik, LLP

(57) ABSTRACT

The invention relates to a stamp (1) comprising a first housing part (3) with a second housing part (4) which can be pivoted relative to the first housing part (3) and with a stamp plate (5) which can be pivoted about an axis (13) disposed in a first end region (12) of the first housing part (3) from a non-operating position into an operating position (10), which stamp plate (5) is disposed between the first housing part (3) and the second housing part (4) in the non-operating position, and when the first housing part (3) is in the operating position (10), the second housing part (4) and the stamp plate (5) form what is approximately a triangle. The second housing part (4) has a guide track (25) locating with the stamp plate (5) and a cam track (18) is disposed on the stamp plate (5) which locates with or can be moved to locate with an operating element (6). Also described is a stamp (1) with a first housing part (3), with an operating element (6) which can be pivoted relative to the first housing part (3) and with a stamp plate (5).

11 Claims, 5 Drawing Sheets

1/5

STAMP

BACKGROUND OF THE INVENTION

The invention relates to a stamp.

From the prior art, pocket stamps are already known, which have a stamp plate and a text plate, which are disposed inside a housing in a transport or non-operating position. In the non-operating position or in the transport position, the pocket stamp can be transported without any risk of ink leaking from the text plate. For stamping purposes, a cover cap must be removed or a folding mechanism operated, which folds out the stamp plate and the text plate.

A portable stamp of this type is known from patent specification U.S. Pat. No. 6,679,168 B1, for example. The stamp comprises a housing, an operating element, a text plate, a retaining handle which can be moved linearly inside the housing and a cover cap. The text plate is mounted so that it can be pivoted on one end of the housing handle. The operating element is connected to the handle part and extends through an orifice of the housing. By means of the linearly displaceable operating element, a user can move the handle part and the text plate out of the housing in readiness for stamping.

Patent specification U.S. Pat. No. 6,098,541 discloses a stamp, whereby different text plates can be pushed alongside an orifice in a housing by means of a linearly displaceable slide. The text plate moved alongside the housing can be folded out in readiness for stamping. This enables the use of different text plates.

Patent specification EP 1 250 234 B1 discloses an elongate stamping device, whereby a stamp plate and an ink pad are mounted so that they can be pivoted on a retaining arm. The stamp pad and the stamp plate are held together by means of a push-on sleeve. For stamping purposes, the push-on sleeve must be removed, after which the stamp pad can be folded away by means of a spring and the stamp plate folded out in readiness for stamping.

Patent specification U.S. Pat. No. 5,105,738 discloses a manual stamp mechanism. It comprises two housing parts which can be pivoted relative to one another and can enclose a stamp plate. The two housing parts may be pivoted towards one another, causing the stamp plate to be pivoted out by means of a guide track disposed in one of the housing parts and a guide pin which locates in the guide track of the housing part and is disposed on the stamp plate.

BRIEF SUMMARY OF THE INVENTION

The objective of this invention is to improve ease of use for a user of a pocket stamp.

This objective is achieved by the invention, independently in each case, on the basis of the disclosed embodiments of the invention.

The features defined by the invention permit a large outward pivoting movement of the stamp plate by means of a relatively small operating path, thereby enabling the use of relatively large or long stamp plates. Another advantage is the fact that the strength of the stamp in the operating position can be significantly improved.

As a result of an embodiment defined by the invention, the stamp is retained and operated more simply and more reliably.

As advantageously defined by the invention, the stamp plate is provided with a cover and a retaining mechanism is provided for a stamp pad in the second housing part.

The advantage of another embodiment defined by the invention is that the second housing part can be folded away by the movement of the stamp plate, thereby enabling the stamp to be opened.

The advantage of an embodiment defined by the invention is that the displacement path of the stamp plate can be more effectively adapted by means of the control cam.

A more compact stamp is obtained as a result of an embodiment defined by the invention.

As a result of an embodiment defined by the invention, a bigger path can be obtained for folding out the stamp plate, which enables bigger stamp plates to be used.

Another embodiment defined by the invention is also of advantage because the resilient mounting of the stamp pad enables the position of the stamp pad to be adapted to the position of the stamp plate and the text plate, thereby resulting in more uniform inking of the text plate. Furthermore, different rubber thicknesses of the text plate can be compensated.

The advantage of another embodiment defined by the invention is that a relatively small operating movement enables a relatively large stamp plate to be pivoted into the operating position.

The advantage of another embodiment defined by the invention is that it permits easier and more reliable handling.

The features defined by the invention further simplify operation.

Other embodiments defined by the invention are also of advantage because they enable the stamp to be easily stored and easily transported.

As a result of the embodiments defined by the invention, the force which needs to be applied in order to open and close the stamp is reduced and the service life of the stamp is increased due to the occurrence of less wear.

The invention will be explained in more detail below with reference to examples of embodiments illustrated in the appended drawings.

BRIEF DESCRIPTION OF THE DRAWINGS

Of these.

DETAILED DESCRIPTION OF THE PREFERRED EMBODIMENTS

Figures 1A, 1B, 1C, 1D:
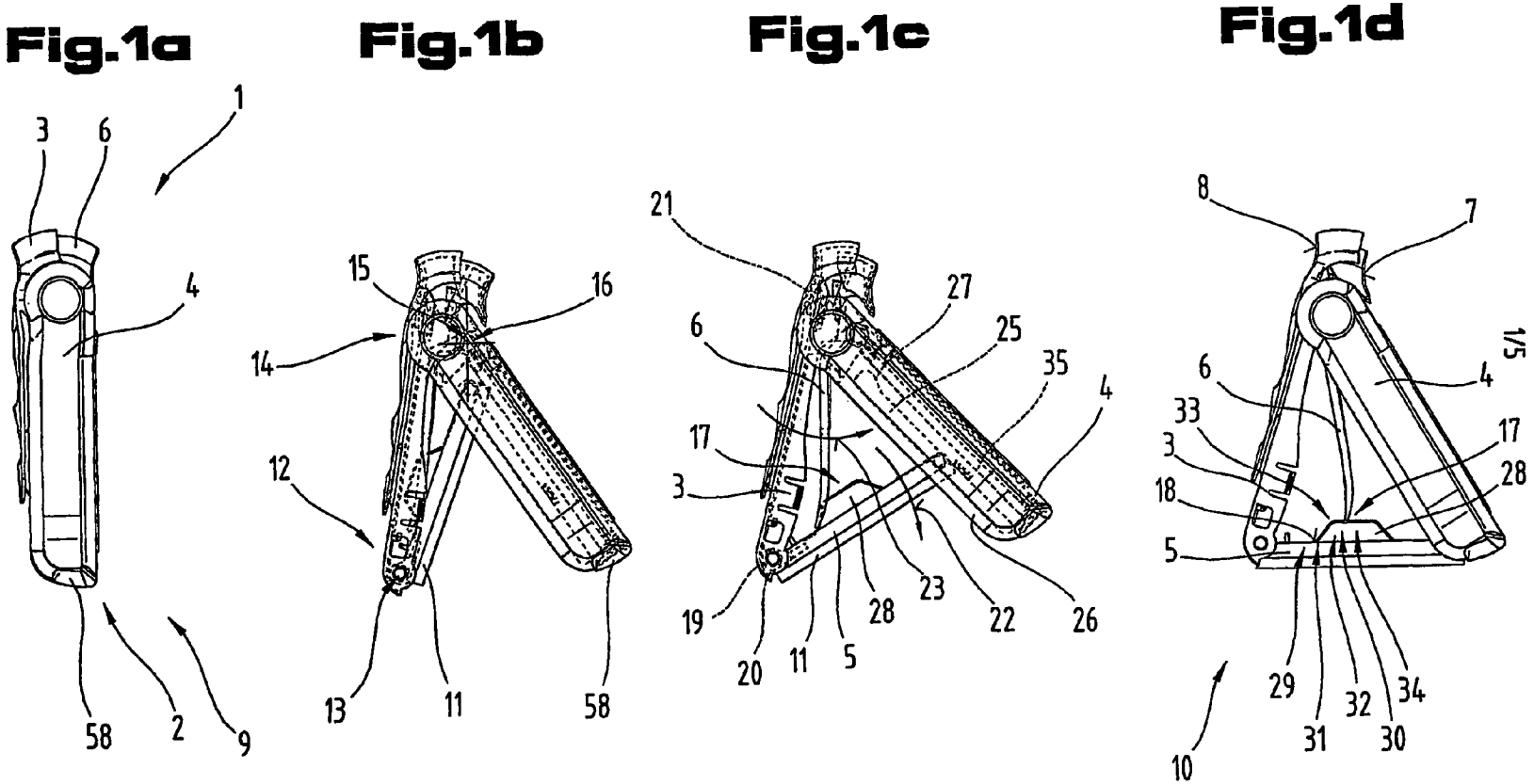
FIG. 1*a* illustrates a stamp in the closed state or in a non-operating position.
FIG. 1*b*, 1*c* illustrates a stamp in a position between a non-operating position and an operating position.
FIG. 1*d* illustrates a stamp in the opened state and in an operating position.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1*a* to FIG. 1*d* illustrate a stamp 1, in particular a pocket stamp 2, in different positions. The stamp 1 comprises a first housing part 3, a second housing part 4 which can be pivoted relative to the first housing part 3, a stamp plate 5 and an operating element 6 with an operating portion 7. The expression pivotable connection in this context is generally intended to mean a connection which can be pivoted about an axis, in particular a virtual axis, and which may optionally permit translating or linear movements of the pivotably connected components.

By compressing the operating portion 7 of the operating element 6 and an operating portion 8 on the first housing part 3, the stamp 1, in particular the pocket stamp 2, can be transferred from a non-operating position 9 into an operating position 10.

In the non-operating position 9, the stamp plate 5, which can be pivoted about an axis 13 disposed in a first end region 12 on which a text plate 11 is mounted for example, is disposed between the first housing part 3 and the second housing part 4, which can be pivoted about an axis 15 disposed in a second end region 14 of the first housing part 3. Accordingly, the longitudinal axes of the first housing part 3, second housing part 4, operating element 6 and preferably also the stamp plate 5 lie more or less parallel with one another. The stamp 1 or pocket stamp 2 is designed so that it is easy to transport in the non-operating position 9. The components constituting the outer casing of the stamp 1, for example the housing parts 3, 4, portions of the operating element 6 and optionally other components, form an almost or totally closed region to prevent a liquid, for example ink, from drying out or leaking. The stamp is preferably made from a plastic material for the most part, in particular an at least partially transparent plastic.

By operating the operating element 6, in particular by compressing the operating portion 7 of the operating element 6 and the operating portion 8 of the first housing part 3, the operating element 6 is pivoted about an axis 16 disposed in the second end region of the first housing part 3 which preferably coincides with the pivot axis 15 of the second housing part 4. This being the case, a cam portion 17 slides along a cam track 18 and thus pivots the stamp plate 5 against a force of a return element 19, in particular a rotating spring 20 connected to the first housing part 3 and the stamp plate 5 and against a force of a return element 21 connected to the operating element 6 and the first housing part 3. As a result, the pivoting direction 22 of the stamp plate 5 is opposite or opposes the pivoting direction 23 of the operating element 6.

By means of one or two pins 24 which slide in one or two guide tracks 25 in the second housing part 4, the second housing part 4 is pivoted out about the axis 15 by means of which the second housing part 4 can be pivoted on the first housing part 3.

The guide track 25 of the second housing part 4 is disposed in a side wall 26 of the second housing part 4. Disposed on one or two end portions of the guide track 25 are openings 27 or curvatures in which the pins 24 of the stamp plate 5 are able to locate for example. In the non-operating position 9 and/or in the operating position 10, the second housing part 4 can be more efficiently locked by means of the opening 27 or curvature in the end portions of the guide track 25 in the second housing part 4. Between the two end portions of the guide track 25, the guide track 25 runs in a more or less linear arrangement.

The cam track 18 on the stamp plate 5, which co-operates or locates with or can be moved so that it locates with the cam portion 17 of the operating element 6, preferably comprises one or two control cams 28. In order to save on material and weight, the control cams 28 are of a web-shaped design. The cam track 18 comprises a first portion 29 disposed on the stamp plate 5, which is formed by a surface more or less parallel with the stamp plate 5, in particular by a slide surface. The cam track 18 also comprises a second portion 30 disposed on the web-shaped control cam 28 or on the web-shaped control cams 28.

The second portion 30 of the cam track 18 extending on the control cam 28 comprises a first rounded region 31 which forms a stepless and/or bend-free transition from the first portion 29 of the cam track 18 on a portion 32 of the cam track 18 extending at an angle to the plane of the first portion 29, the inclined portion 32, another rounded region 33 which forms a transition between the inclined portion 32 and a portion 34 extending more or less parallel with the plane of the first portion 29 of the cam track 18 and the portion 34 extending parallel with the first portion 29.

In a portion 34 of the cam track 18 extending approximately parallel with the first portion 29 which preferably runs on the control cam 28, the operating element 6 or a cam portion 17 of the operating element 6 locating with the cam track 18 overcomes a top dead centre point during the process of folding the stamp plate 5 back into the non-operating position. Once a cam portion 17 of the operating element 6 locating with the cam track 18 overcomes this top dead centre point, it is no longer possible to transfer the stamp plate 5 into the non-operating position 9 by means of a force applied to the stamp plate 5, for example a pressing force exerted with a view to stamping. This prevents the stamp plate from inadvertently folding back.

The stamp plate 5 is transferred back into the non-operating position 9 by releasing the force by means of which the operating portion 7 of the operating element 6 and the operating portion 8 of the first housing part 3 are compressed, whereupon the operating element 6 is moved in the direction of its non-operating position 9 by means of the return element 21, and the cam portion 17 of the operating element 6 locating with the cam track 18 is therefore moved back out of the top dead centre position or top dead centre region. The stamp plate 5 is then pushed in the direction of its non-operating position 9 by means of the return element 19, in particular by means of the rotating spring 20.

In another embodiment, an additional recess or raised area is provided along the cam track 18, in particular on the control cam 28, thereby resulting in a fixing means for the operating element 6 and increasing the strength of the stamp 1 in the operating position 10. Such a fixing mechanism may also be provided for the non-operating position 9, for example in the form of a snap-fit connection.

In other embodiments of a fixing mechanism, a recess is provided in the second housing part 4 or in the region of the guide track, through which a locking element to secure the stamp plate 5 can be introduced. The locking element may be an office clip, a writing implement or an element of a fixing mechanism 39—FIG. 2*a*—or an element of a housing part 3, 4, for example a resilient arm. The recess is preferably disposed in a side wall 26 of the housing part 3, 4.

Whilst the text plate 11 disposed on the stamp plate 5 can be pressed against an object such as a piece of paper in the operating position 10 in order to transfer an ink from the text plate 11 to the object, the text plate 11 can be coated or impregnated with ink in the non-operating position 9. To enable the text plate 11 to be coated with ink in the non-operating position 9, an ink or stamp pad 35 is accommodated in the second housing part 4. The stamp pad 35 is preferably resiliently mounted in order to compensate for any misaligned positions of the text plate 11 and stamp plate 5. The resilient or elastic mounting of the stamp pad also compensates for different text plate thicknesses. This permits the use of different text plate materials. The resilient mounting compensates for differences of between 1 mm and 3 mm, for example.

Figure 2B:
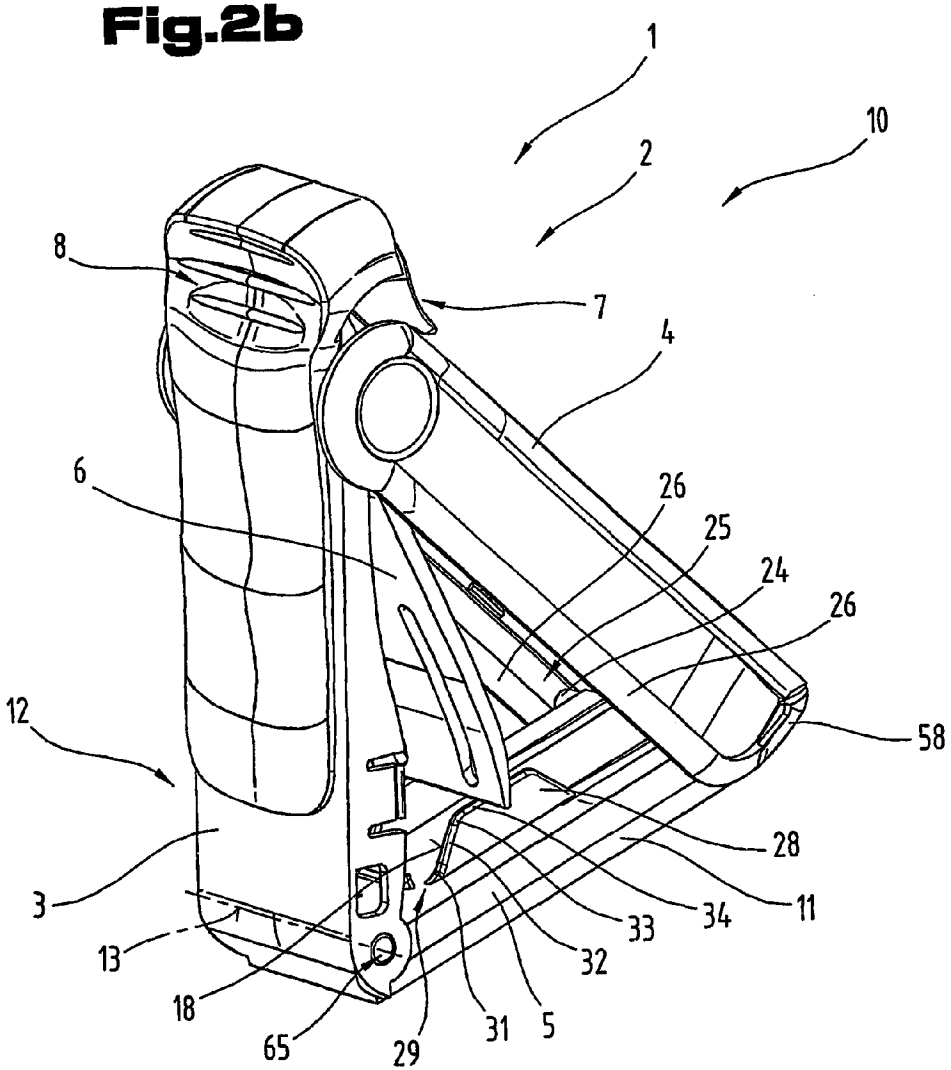
FIG. 2*b* is a perspective view of a stamp in an operating position.
Figure 2A:
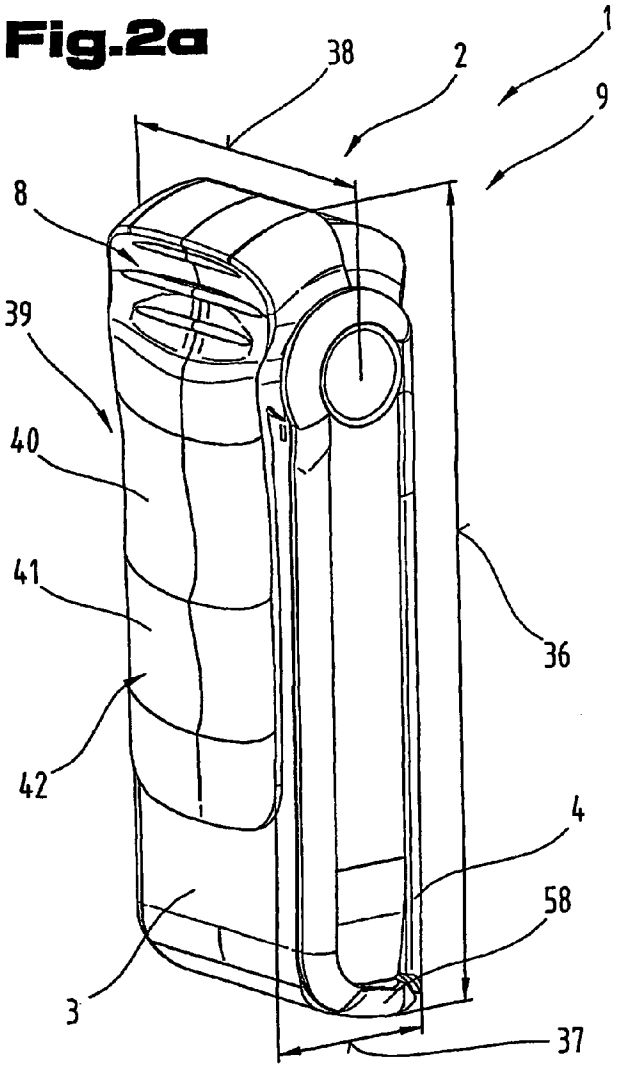
FIG. 2*a* is a perspective view of a stamp in a non-operating position.

FIG. 2*a* illustrates a perspective view of a stamp 1 or pocket stamp 2 in the non-operating position 9. Compared with the length 36 of the stamp 1, the stamp 1 has a relatively short depth 37, which is in the range of between 5 mm and 30 mm, in particular approximately 15 mm. As a result, the stamp 1 is of a bar-type or plate-type shape and can be easily inserted in a pocket, for example in the breast pocket of a shirt. The width 38 of the stamp 1 will depend on the respective text plate 11 used—FIG. 1*c*—and is in the range of approximately 10 mm to approximately 80 mm. The length 36 of the stamp 1 in the non-operating position 9 likewise depends on the shape of the text plate 11 and is between 25 mm and 100 mm, preferably approximately 75 mm, for example.

To enable the stamp 1 to be stowed or transported more easily, a fixing mechanism 39 is provided on the first housing part 3. The fixing mechanism 39 comprises a bar-shape d fixing element 40 or a clip 41, for example. The fixing element 40 or clip 41 is designed to be attached to textiles, for example to a shirt pocket. The clip or fixing element 40 preferably has a gripping surface 42 by means of which the stamp 1 can be ergonomically handled.

FIG. 2*b* illustrates the stamp 1 or pocket stamp 2 in the operating position 10 in which the first housing part 3, second housing part 4 and stamp plate 5 form an approximate triangle or delta shape.

Figure 3:
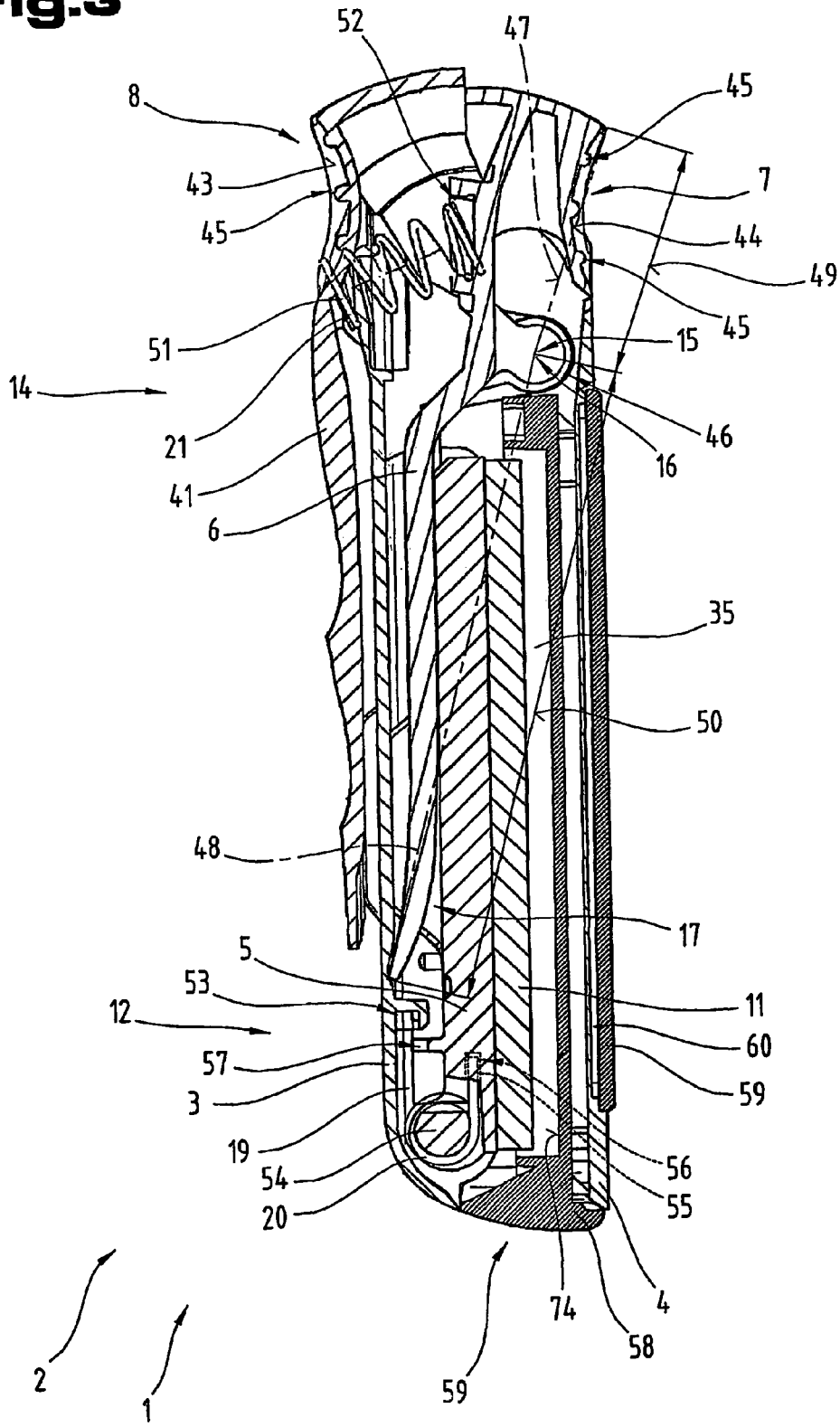
FIG. 3 shows a longitudinal section through a stamp in a closed state or in a non-operating position.

FIG. 3 is a view of a stamp 1 or pocket stamp 2 seen in section. The stamp 1 is illustrated in a non-operating position 9 in this instance. As may be seen, the operating portion 8 of the first housing part 3 and the operating portion 7 of the operating element 6 act as gripping surfaces 43, 44 provided with webs 45 extending transversely to the longitudinal extension. The operating element 6 is mounted so that it is able to pivot relative to the first housing part 3 by means of the bearing mechanism 46.

The operating element 6 forms a first lever arm 47 and a second lever arm 48. The length 49 of the first lever arm 47 is between one half and one tenth of the length 50 of the second lever arm 48, in particular the length 50 of the second lever arm 48 is approximately 5 times longer than the length 49 of the first lever arm. Disposed in the region of the first lever arm 47 of the operating element 6 are the gripping surface 44 and the return element 21.

The return element 21 is preferably provided in the form of a compression spring 51 and is disposed in a mounting element 52. The spring 51 hits the operating element 6 in the region of the first lever arm 47 of the first housing part 3 so that the operating element 6 in the region of the second lever arm 48 is pushed against the first housing part 3. When the operating portions 7, 8 are not being operated, the operating element 6 is moved back into the non-operating position 9 by the return element 21 and by the spring 51.

In another embodiment, the return element 21 is integrated in the first and second housing part 3, 4 and/or in the operating element 6 in the form of a resilient element. The return element 21 may be provided in the form of a spiral, leaf or lug-type spring, disposed integrally on the housing parts 3, 4 or on the operating element 6 in particular. This obviates the need for mounting means and saves on the cost of a compression spring.

The first housing part 3 also has a mounting element 53 by means of which the return element 19 is retained and which pushes the stamp plate 5 in the direction of the non-operating position 9 and the first housing part 3. The return element 19 or rotating spring 20 is also accommodated on and retained by a pin 54 on the stamp plate 5 and in a recess 55 in the stamp plate 5 which forms a mounting element 56 for the return element 19 or rotating spring 20.

Also disposed on the stamp plate 5 is a mounting web 57, which acts as a mounting aid for fitting the return element 19 and rotating spring 20. As a result, the rotating spring 20 can be secured on only the stamp plate 5 initially, thereby making it easier to introduce the rotating spring 20 into the mounting element 53 of the first housing part 3.

In order to coat or impregnate the text plate 11 with ink in the non-operating position 9, the stamp pad 35 is accommodated in the second housing part. In this connection, the stamp pad 35 is disposed in a pad holder element 58 detachably disposed on the second housing part. The pad holder element 58 with the stamp pad 35 may be pushed into a front face 59 of the stamp. The pad holder element 58 has resilient or elastic elements, which expend a force in the direction of the text plate 11. This enables inclined positions of the text plate 11 to be compensated and the text plate 11 to be coated uniformly with ink.

An at least partially transparent cover element 59 is also disposed on one of the housing parts 3, 4, preferably on the second housing part 4. The cover element 59 and the housing parts 3, 4 form an intermediate space 60, in which a text insert can be placed. In another embodiment, the cover element 59 lies directly on the housing parts 3, 4. The cover element 59 is secured by means of a snap-fit closure or an adhesive connection 3, 4, for example. The text insert may contain information about the owner of the stamp 1 and/or information about the image presented or engraved on the text plate 11.

Figure 4A:
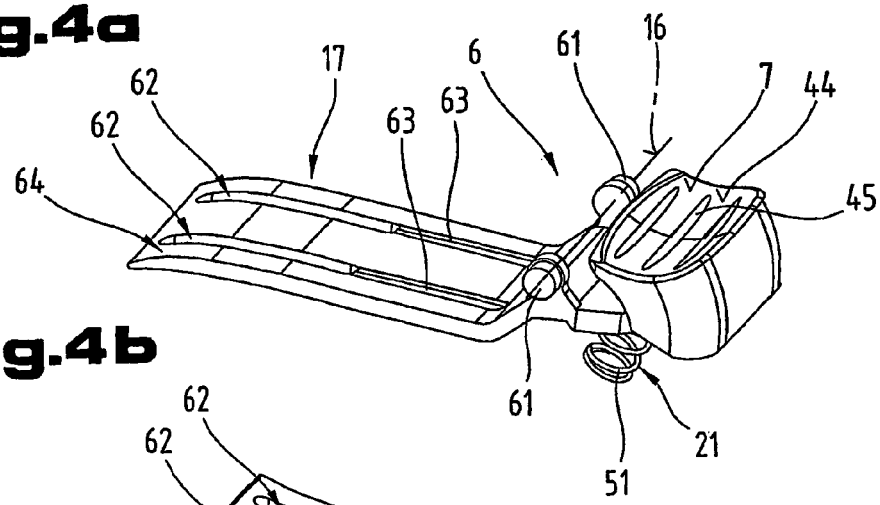
FIG. 4*a* is a perspective view of an operating element with an inserted return element.
Figure 4B:
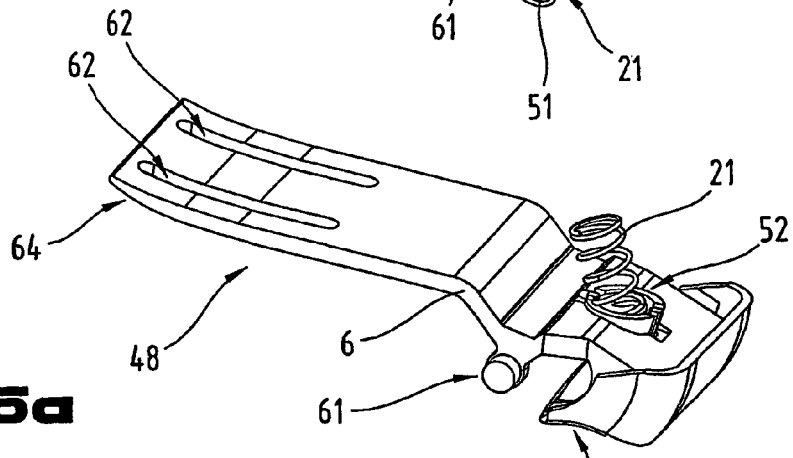
FIG. 4*b* is a perspective diagram showing an operating element from underneath with the return element inserted.

FIG. 4*a* and FIG. 4*b* are perspective diagrams showing details of the stamp 1 and illustrate the operating element 6 and the return element 21. They show the operating portion 7, which forms the gripping surface 44 with the webs 45, two bearing pins 61 by means of which the operating element 6 is pivotably mounted on the first housing part 3—FIG. 2*b*—the cam portion 17 of the operating element 6 which slides and/or rolls on the cam track 18—FIG. 1*d*—two recesses 62 in which the control cams 28—FIG. 1*d*—are able to locate in the non-operating position 9—FIG. 1*a*—and two reinforcing webs 63 and the return element 21 or spring 51, which is secured on the operating element 6 by means of the mounting element 52.

The recesses 62 for the control cams 28 are adapted to the dimensions of the control cams 28. The recesses 62 are elongate and rounded at the ends. The recesses 62 may be spaced apart from the control cams 28 in the non-operating position 9 or co-operate with them to form a positive or friction fit with them in order to serve as a fixing mechanism for the non-operating position 9 of the stamp 1.

In the cam portion 17, the operating element 6 forms a rounded region 64, off which the stamp plate 5 is able to roll at least partially when being folded open. The shape of the rounded region 64 may be based on a gearing principle, in which case the rounded region 64 is of an involute shape.

In other embodiments, the operating element 6 is coated with an anti-friction varnish for example, at least in the region of the cam portion 17. This reduces friction and wear and facilitates handling. The bearing pin 61 and/or the bearing mechanism 46 in which the bearing pin 61 locates may also be coated with an anti-friction coating.

In other embodiments, elements of the roller type are mounted on the cam portion 17 of the operating element 6, for example in the form of sliding sleeves or roller bearing type, in order to reduce friction and increase service life. Sliding sleeves or rollers may also be disposed on the bearing pin 61 and/or on the bearing mechanism 46.

Figure 5A:
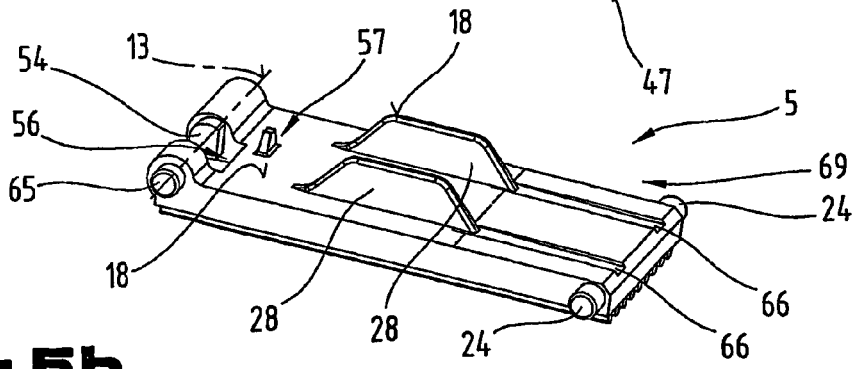
FIG. 5*a* is a perspective view of a stamp plate with control cams.
Figure 5B:
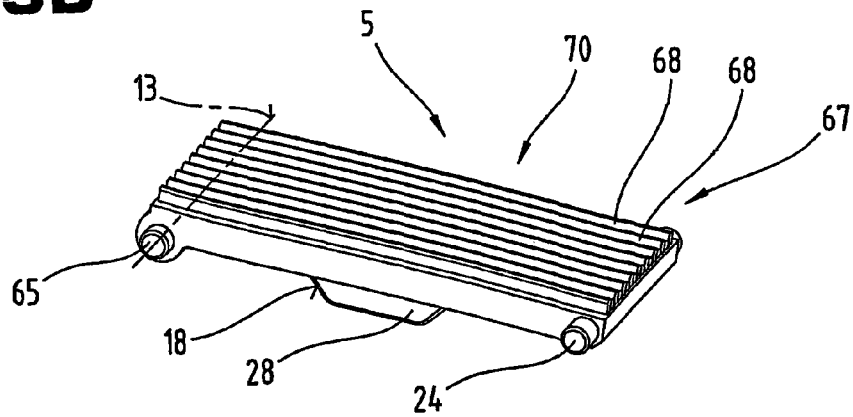
FIG. 5*b* illustrates a stamp plate with a device for accommodating characters.

FIG. 5*a* and FIG. 5*b* show other perspective diagrams of details of the stamp 1—FIG. 1*d*—which illustrate an embodiment of a stamp plate 5.

These illustrate the two web-shaped control cams 28 disposed on the stamp plate 5, the mounting web 57 for facilitating fitting of the return element 19, the pin 54 by means of which the return element 19 is held in position, the bearing pin 65 by means of which the stamp plate 5 is connected to the first housing part 3—FIG. 1*d* so that it is able to pivot about the axis 13, the two pins 24 by means of which the stamp plate 5 is connected to the second housing part 4—FIG. 1*d*—and which slide in the guide track 25—FIG. 1*c*, FIG. 2*b*—of the second housing part 4, as well as the recesses 66 in which the reinforcing webs 63 of the operating element 6—FIG. 4*a*—locate in the non-operating position 9.

The embodiment of the stamp plate 5 illustrated in FIG. 5*a* and FIG. 5*b* also has a holder device 67 for characters. The holder device 67 is formed by webs 68 extending parallel, on which characters can be fitted. This offers a simple way of producing individual text plates 11 which can be easily modified.

In other embodiments, elements which are able to move to establish a connection with other components are provided with an anti-friction coating, for example an anti-friction varnish. For example, the bearing pin 65, the pin 54 for holding the return element 19, the cam track 18 and/or the pin 24 which locates in the guide track 25 are coated with an anti-friction varnish or an anti-friction coating.

In other embodiments, sliding sleeves are provided on the bearing pins 61, 65 in order to improve operation and deployment of the stamp 1. Guide sleeves or rollers may also be provided on the pins 24 which locate in the guide track 25 in order to reduce frictional resistance and increase the service life of the guide.

Figure 6:
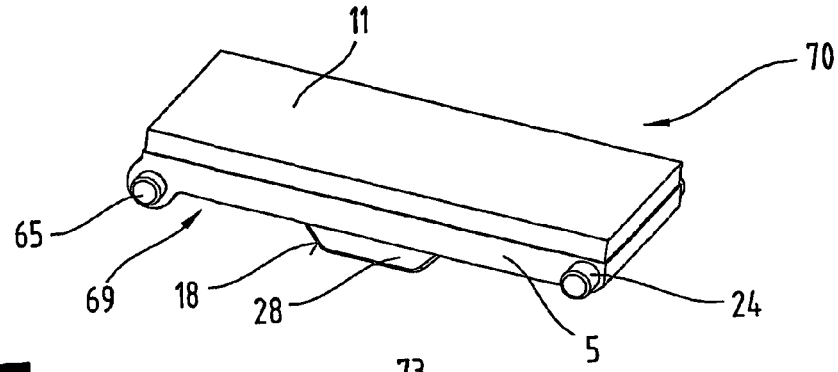
FIG. 6 shows a perspective view of another embodiment of a stamp plate.

FIG. 6 is a perspective diagram showing a detail of another embodiment of the stamp 1.

The embodiment of the stamp plate 5 illustrated in FIG. 6 is designed for holding a text plate 11. The text plate 11 (illustrated without text) is adhered to the stamp plate 5 for example and has a thickness of between 1 mm and 5 mm, preferably between 2 mm and 4 mm. The text plate 5, which is also referred to as a die plate in technical jargon, is made from a rubber-type material, into which a negative of a motif or text is engraved. The top face 69 of the stamp plate 5 more or less corresponds to the top face 69 of the embodiment of the stamp plate 5 illustrated in FIG. 5*a*.

Figure 7:
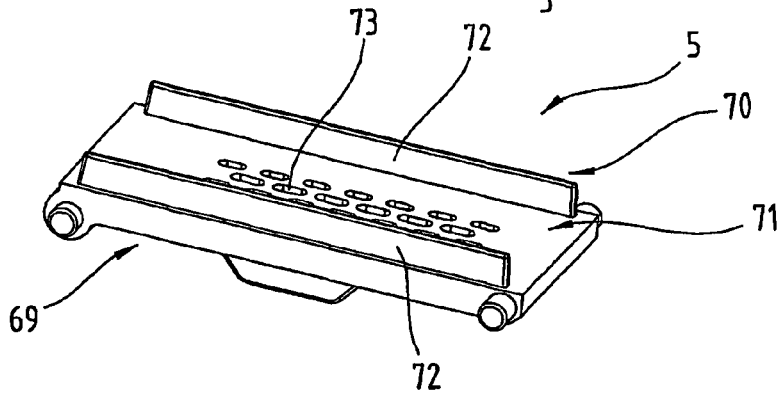
FIG. 7 shows a perspective view of another embodiment of a stamp plate with a device for housing an interchangeable text plate.

FIG. 7 is another perspective diagram illustrating a detail of another embodiment of the stamp 1.

The bottom face 70 of the embodiment of the stamp plate 5 illustrated in FIG. 7 is designed to accommodate an interchangeable text plate 11. To this end, the stamp plate 5 has a holder device comprising two laterally disposed webs 72 and optionally recesses 73. The recesses 73 are preferably elongate orifices and prevent the inserted text plate 11 from sticking to the stamp plate 5 for example. The recesses 73 may also be designed to accommodate lugs or webs disposed on the text plate 11 and thus secure the stamp plate 11.

The embodiment of the stamp plate 5 illustrated in FIG. 7 may also be designed to accommodate a self-inking text plate 11. The self-inking text plate 11 may hold ink in one or more cavities and emit it during the stamping operation. The self-inking text plate 11 is preferably made from a material which can be impregnated with liquid, for example a foam material or fibre material. Liquid, in particular ink, can be applied to the text plate 11 by means of the continuous recesses 73, thereby topping it up.

Figure 8:
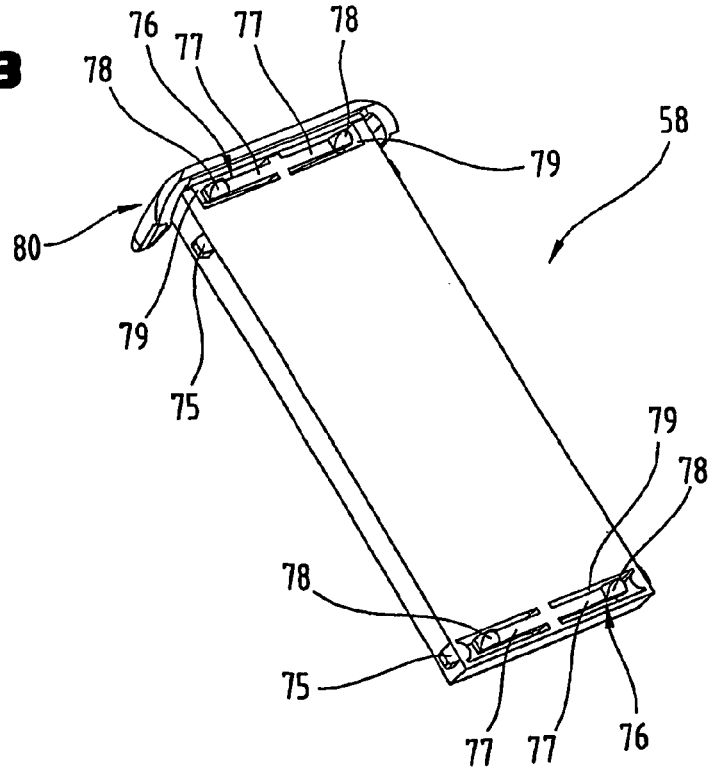
FIG. 8 illustrates a device for housing a stamp pad with spring elements.

FIG. 8 is a perspective diagram illustrating a detail of the stamp 1 showing the pad holder element 58.

The pad holder element 58 forms a sump 74—FIG. 3—in which the stamp pad 35 is disposed. The pad holder element 58 is pushed into the front face 59 of the second housing part 4 and slides in a guide track of the second housing part 4 by means of guide elements 75. To enable the stamp pad to be better adapted to the position of the text plate 11 and stamp plate 5—FIG. 3—the pad holder element 58 has two spring elements 76 respectively in each of the end portions.

The spring elements 76, of which there are four in total at the corners of the pad holder element 58, are provided in the form of resilient arms 77, on one end of which a fitting element 78 is respectively provided, whilst the other end is integrally joined to the pad holder element 58. An opening 79 is provided around the resilient arms 77 to allow the resilient arms 77 to move. The fitting elements 78 lie against the second housing part 4 and expend a force in the direction of the text plate 11 and stamp plate 5.

In alternative embodiments, the pad holder element 58 is elastically mounted by plate springs or by one or more separate resilient parts. The plate springs or resilient parts may be adhered to or push-fitted on the pad holder element 58. For example, the resilient part is provided in the form of an elastic foam layer. The resilient parts or spring elements 76 may also have damping properties to compensate for vibrations or impacts.

In order to make the pad holder element 58 easier to change, it also has an operating portion 80 or an operating element.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

The embodiments illustrated as examples represent possible design variants of the stamp 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the stamp 1 or pocket stamp 2, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1*a*, 1*b*, 1*c*, 1*d*, 2*a*, 2*b*; 3; 4*a*, 4*b*; 5*a*, 5*b*; 6; 7; 8 constitute independent solutions proposed by the invention in their own right. The objectives and associated solutions proposed by the invention may be found in the detailed descriptions of these drawings.

The invention claimed is:

1. A Stamp comprising a first housing part with a second housing part which can be pivoted relative to the first housing part and with a stamp plate, which can be pivoted about an axis disposed in a first end region of the first housing part from a non-operating position into an operating position, which stamp plate is disposed between the first housing part and the second housing part in the non-operating position, and when the first housing part is in the operating position, the second housing part and the stamp plate form what is approximately a triangle, and the second housing part has a guide track locating with the stamp plate and a cam track is disposed on the stamp plate which locates with or can be moved to locate with an operating element, and the operating element can be pivoted relative to the first housing part from a non-operating position into an operating position, and the operating element is disposed between the first housing part and the stamp plate in the non-operating position, and when the first housing part is in the operating position, the operating element and the stamp plate form what is approximately a triangle, wherein a control cam is disposed on the stamp plate which forms at least a portion of the cam track.

2. The stamp as claimed in claim 1, wherein the operating element has at least one recess in which the control cam locates, in the non-operating position.

3. The Stamp as claimed in claim 1, wherein a pivoting direction of the operating element is opposite a pivoting direction of the stamp plate.

4. The Stamp as claimed in claim 1, wherein a resiliently mounted stamp pad is disposed in the second housing part.

5. The Stamp as claimed in claim 1, wherein the operating element comprises a first lever arm and a second lever arm, and the length of the second lever arm corresponds to between two and ten times, the length of the first lever arm.

6. The Stamp as claimed in claim 5, wherein the first lever arm has a gripping surface.

7. The Stamp as claimed in claim 5, wherein a return element is connected to at least one of the first housing part, the second housing part, the operating element or the stamp plate.

8. The Stamp as claimed in claim 7, wherein the return element is designed to at least partially guide the stamp plate from the operating position back into the non-operating position.

9. The Stamp as claimed in claim 1, wherein a fixing mechanism is disposed on at least one of the first housing part, the second housing part, or the operating element.

10. The Stamp as claimed in claim 9, wherein the fixing mechanism comprises an elastic or elastically mounted fixing element.

11. The Stamp as claimed in claim 1, wherein the cam track or the guide track have anti-friction surfaces.

* * * * *